US012378702B2

(12) United States Patent
Chen

(10) Patent No.: US 12,378,702 B2
(45) Date of Patent: Aug. 5, 2025

(54) MANUFACTURING METHOD OF SINGLE-MATERIAL IRREGULAR EXTENSION MULTIPLE LONG-ACTING FUNCTIONAL TEXTURED YARN, THE TEXTURED YARN THEREOF, AND THE FABRIC MADE WITH THE TEXTURED YARN THEREOF

(71) Applicant: TUNTEX INCORPORATION, Kaohsiung (TW)

(72) Inventor: Yu-Lung Chen, Kaohsiung (TW)

(73) Assignee: TUNTEX INCORPORATION, Kaohsiung (TW)

( * ) Notice: Subject to any disclaimer, the term of this patent is extended or adjusted under 35 U.S.C. 154(b) by 110 days.

(21) Appl. No.: 18/126,384

(22) Filed: Mar. 25, 2023

(65) Prior Publication Data

US 2024/0318361 A1 Sep. 26, 2024

(51) Int. Cl.

| | |
|---|---|
| ***D01D 5/08*** | (2006.01) |
| ***D01D 5/16*** | (2006.01) |
| ***D01D 10/02*** | (2006.01) |
| ***D01D 10/04*** | (2006.01) |
| ***D01F 1/04*** | (2006.01) |
| ***D01F 6/62*** | (2006.01) |
| ***D01F 11/08*** | (2006.01) |

(Continued)

(52) U.S. Cl.

CPC ..... *D01F 11/08* (2013.01); *D01D 10/02* (2013.01); *D01D 10/0436* (2013.01); *D01D 10/0445* (2013.01); *D02G 1/0206* (2013.01); *D02G 1/024* (2013.01); *D10B 2331/04* (2013.01)

(58) Field of Classification Search

CPC ..... D01D 5/08; D01D 5/16; D01D 10/02; D01D 10/0436; D01D 10/0445; D01F 1/04; D01F 6/62; D02G 1/0206; D02G 1/024; D02G 3/02; D02G 3/34; D02J 1/08; D02J 13/00; D10B 2331/04

USPC ..... 264/103, 210.6, 210.8, 290.5, 331.21; 28/271; 57/328

See application file for complete search history.

(56) References Cited

FOREIGN PATENT DOCUMENTS

| | | | | |
|---|---|---|---|---|
| CN | 105755620 A | * | 7/2016 | ..... D02G 3/34 |
| CN | 105908282 A | * | 8/2016 | ..... D02G 1/0206 |
| CN | 111748886 A | * | 10/2020 | ..... D02G 3/34 |

OTHER PUBLICATIONS

Translation of CN 105755620 A (published on Jul. 13, 2016.*
Translation of CN 105908282 A (published on Aug. 31, 2016.*
Translation of CN 111748886 A (published on Oct. 9, 2020).*

* cited by examiner

*Primary Examiner* — Leo B Tentoni
(74) *Attorney, Agent, or Firm* — Ying-Ting Chen; Law Office of Michael Chen

(57) ABSTRACT

The present invention relates to a manufacturing method of a unique textured yarn by upgrading the equipment and processing the modified single-material precursor, the textured yarn thereof, and the fabric made with the textured yarn thereof. According to the method, titanium dioxide is added into a precursor of PET pre-oriented yarn with single filament DPF<0.5 to form the first precursor. Then, the first precursor is fed into a flat conveying roller, and then into a differential roller, and then into an accelerating roller to form a dark and light double colored textured yarn with linen-like appearance and tone. Then, the dark and light double colored textured yarn is conveyed to a heater for heating and setting, and then conveyed to a false twisting machine for processing. Finally, it is conveyed to a nozzle for spraying.

1 Claim, 4 Drawing Sheets

(51) Int. Cl.

| | |
|---|---|
| ***D02G 1/02*** | (2006.01) |
| ***D02J 1/08*** | (2006.01) |
| ***D02J 13/00*** | (2006.01) |

MANUFACTURING METHOD OF SINGLE-MATERIAL IRREGULAR EXTENSION MULTIPLE LONG-ACTING FUNCTIONAL TEXTURED YARN, THE TEXTURED YARN THEREOF, AND THE FABRIC MADE WITH THE TEXTURED YARN THEREOF

BACKGROUND OF INVENTION

1. Field of the Invention

The present invention relates generally to a manufacturing method of textured yarn, and more particularly to a unique manufacturing method of textured yarn to produce linen-like appearance and tone, good UV resistance, moisture absorbing and quick drying properties, high elasticity, and the feel of cotton, using improved equipment to process the modified precursor, and to the fabric made with the textured yarn thereof.

2. Description of Related Art

The textile industry plays an important role in the Taiwanese economy and is one of the pivotal civilian industries. The textile manufacturing processes mainly include fiber manufacturing, spinning, weaving, dyeing and finishing, and garment manufacturing. Over the years, through unremitting efforts and continuous investments by the manufacturers, the textile industry in Taiwan has become a massive and complete manufacturing system and the manufactured products are exported to numerous countries in the world. It is no doubt a pivotal exporting industry.

In recent years, with the rapid development of material technologies, many man-made fibers are used to produce fabrics with special properties, such as high elasticity, electrical resistance, moisture absorbing and quick drying properties, good resistance to Ultraviolet (UV), Far Infrared (FIR) and electromagnetic waves, protection against mosquitoes, anion generation, bacteria resistance and smell elimination, so as to meet the various demands of different consumer groups. Many manufacturers are investing in the research and development of functional textile products that offer innovative functions. Among them, many functional textile products are produced by grinding relevant materials into nanoparticles and adding them into the precursor so that it can have special functions. Although functional textile products can have many innovative functions, most manufacturers conduct research and development with the consideration of product appearance only and many products do not meet the actual need of consumers.

However, functional textile products still form a huge potential market. As consumers are increasingly concerned about health, fashion and environment protection, the market is demanding more functional textile products. Therefore, the design of functional textile products shall take many aspects into consideration, paying attention to the consumer needs as well as environmental impacts. According to the recent industrial trend, consumers have an increasing demand for textile products with high UV resistance, moisture absorbing and quick drying properties, and high elasticity. With the prevalence of fast fashion over the recent years, the product manufacturing processes and techniques must be adjusted accordingly. Therefore, many textile manufacturers are keen on developing new techniques to produce textile products with UV-resistant, moisture-absorbing, quick drying properties and high elasticity, and to significantly reduce the manufacturing processes to enhance efficiency. Furthermore, the products can have linen-like appearance and tone as well as the feel of cotton, so that consumers can easily accept the new products and buy a lot.

In terms of the materials used by the current textile industry, polyester fiber accounts for a significant percentage. Polyester fiber is a high molecular polymer made from saturated dibasic acid and dibasic alcohol via polycondensation reaction, and is a filament fiber with the length of each single fiber up to 100 feet. It has the advantages of high strength and durability, good wrinkle resistance, washing fastness, and resistance to acids and bases. However, comparing with other kinds of fibers, polyester fiber has the disadvantages of poor moisture absorption, insufficient elasticity and uncomfortable feel. In view of this, it has become an important issue for fiber and textile processing manufacturers to develop textured fibers with high UV resistance, good moisture-absorbing and quick-drying property, high elasticity, significantly enhanced processing efficiency, linen-like appearance and tone, and the feel of cotton.

SUMMARY OF THE INVENTION

In view of the above technical issue, the inventor has been dedicated to sophisticated research and development. Relying on an industrial mind and years of professional experience in product innovation, the inventor made numerous trials and has finally presented the present invention to enhance the manufacturing processes and overcome the existing shortcomings.

The main object of the present invention is to develop a single-material irregular extension multiple long-acting functional textured yarn (PRKHC) by means of equipment upgrading to reduce manufacturing processes and enhance processing efficiency.

The other object of the present invention is to provide a technique to upgrade the manufacturing processes by adopting a false twisting process for the polyester fibers to produce high elasticity and a linen-like appearance and tone, as well as the feel of cotton, and to produce textured yarns having good UV resistance, moisture-absorbing and quick drying properties, a fluffy feel and good elasticity through improvement of the manufacturing method and modification of the precursor, while considerably reducing the manufacturing processes and enhancing the processing efficiency.

To fulfill the above objects, the manufacturing method of single-material irregular extension multiple long-acting functional textured yarn (PRKHC) of the invention mainly comprises selection of precursor, differential processing, heating and setting, false twisting and deforming, and air pressure spraying. The steps are described as follow:

First, select a precursor of PET pre-oriented yarn (POY) with residual extension difference of 150%~160%, natural draw ratio (NDR) of more than 1.4%, and single filament DPF<0.5, and modify it by adding 0.8%~1.2% titanium dioxide to form the first precursor; then, feed the first precursor into a flat conveying roller with a speed of 68~73M/min, and then into a differential roller with a speed of 59~64M/min, and then into an accelerating roller with a speed of 95~102M/min, thus producing a textured yarn with linen-like appearance and tone, having a dark and light double-color feeling. Characteristically, the differential roller is made up of a rubber roller and a metal embossed roller. When the first precursor passes the convex part of the metal embossed roller, the speed is 78~84M/min, and when the first precursor passes the concave part of the metal embossed roller, it does not touch the rubber roller, and the speed is 89~96M/min; then, the dark and light double colored textured yarn is fed into a heater for heating and setting, the heating temperature of the heater being 180° C.~200° C.; after heating and setting, the dark and light double colored textured yarn is conveyed to a false twisting machine to be processed at a twist degree of 2200~2500 T/M to produce a textured yarn with the feel of cotton. Specifically, the false twisting machine uses modified Mitsubishi ST-5 pin type. Finally, through a middle feeding roller with a speed of 125~135M/min, the textured yarn with the feel of cotton after false twisting and deforming is conveyed to a spraying nozzle of 75~85 knot/m. After spraying, a single-material irregular extension multiple long-acting functional textured yarn (PRKHC) is formed.

Then, the single-material irregular extension multiple long-acting functional textured yarn (PRKHC) is woven with a regenerated fiber (RePreve) to form a fabric (Cloth No.: B1149, Specification: Warp density 111 Picks/inches, Weft density 103 Picks/inches, Width 57", Weight 265 g/y). Specifically, the weight percentage of the single-material irregular extension multiple long-acting functional textured yarn (PRKHC) is approximately 70~80%, the weight percentage of the regenerated fiber (RePreve) is approximately 20~30%, making a 78:22 proportion between the single-material irregular extension multiple long-acting functional textured yarn (PRKHC) and the regenerated fiber (RePreve).

Thus, through the present invention, the single-material irregular extension multiple long-acting functional textured yarn (PRKHC) can have linen-like appearance and tone, and good functional effects such as UV resistance, moisture absorbing and quick drying properties, high elasticity, and the feel of cotton. The present invention can considerably reduce materials, manufacturing processes, and extra additives. The advantages are detailed below:

(1) Good UV resistance: The precursor of PET pre-oriented yarn (POY) with single filament DPF<0.5 is modified through the addition of 0.8%~1.2% titanium dioxide to form a precursor with high UV resistance. Thus, the yarns and fabrics produced after processing can have the function of long-acting UV resistance, which will not disappear after washing.

(2) Moisture absorbing and quick drying properties and high elasticity: The present invention uses ultra-fine modified precursor of PET pre-oriented yarn (POY) with single filament DPF<0.5 for processing and manufacturing. Through improved manufacturing processes, the final product can have moisture absorbing and quick drying properties as well as high elasticity.

(3) A linen-like appearance with the feel of cotton: The modified precursor undergoes the different speeds of the flat conveying roller, the differential roller and the accelerating roller to form continuously varying dye zones with dark and light colors. Furthermore, after heating and setting, false twisting and spraying, the final product can have a fluffy cotton feel. Through the present invention, the manufacturing processes are considerably reduced, and the product can have a special linen-like appearance and tone, as well as a comfortable cotton-like feel.

DETAILED DESCRIPTION OF THE INVENTION

For better understanding of the objects, technical means, and advantages of the invention, the description of the invention is further detailed with reference to actual implementations. It is to be noted that the following embodiments are not intending to limit the scope of the invention, and all replacements and variations made on the basis of common technical knowledge and conventional means without departing from the spirit of the present invention shall fall within the scope of the invention.

Figure 1:
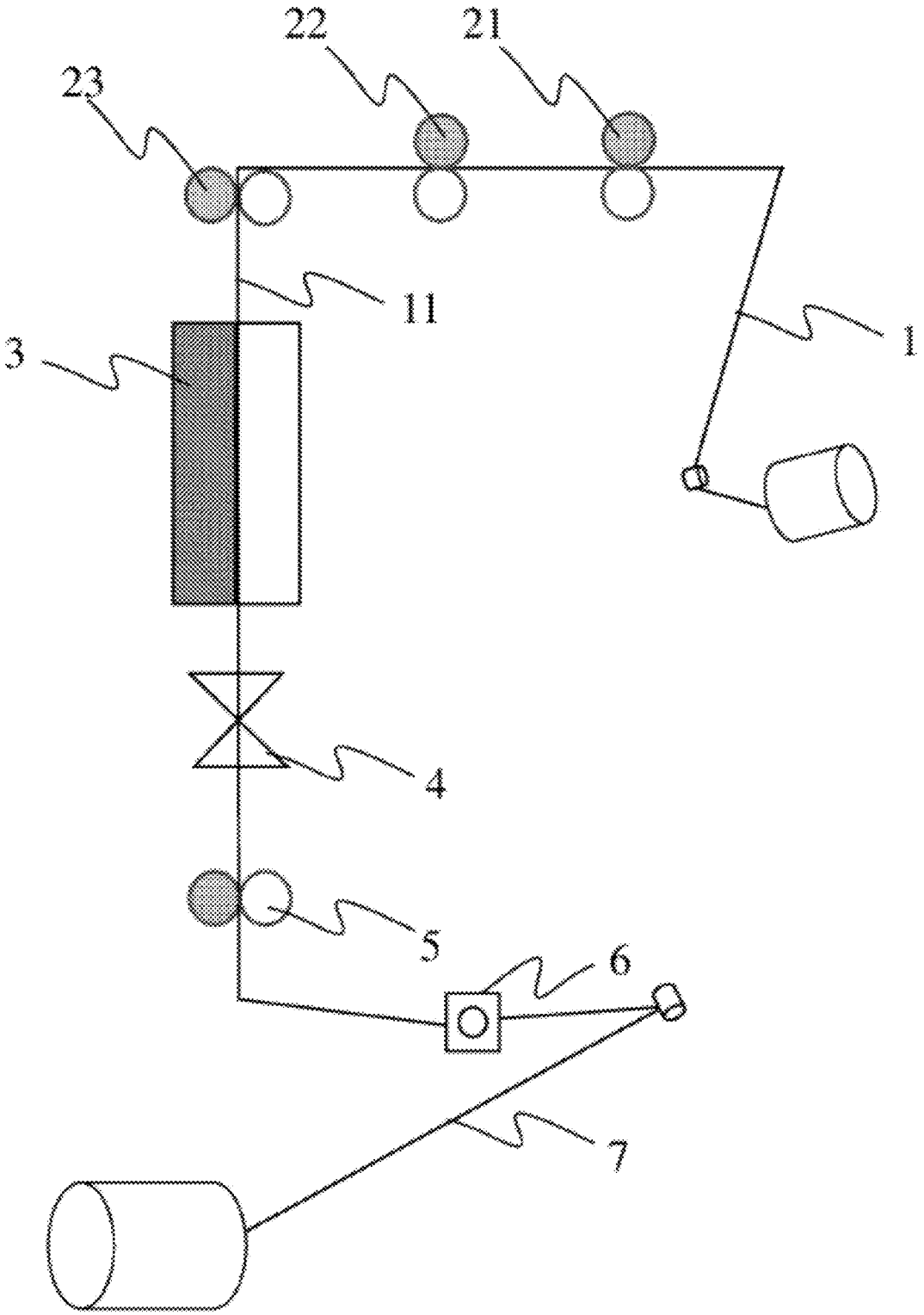
FIG. 1 is a flow chart of the manufacturing method of single-material irregular extension multiple long-acting functional textured yarn according to the invention.
Figure 2:
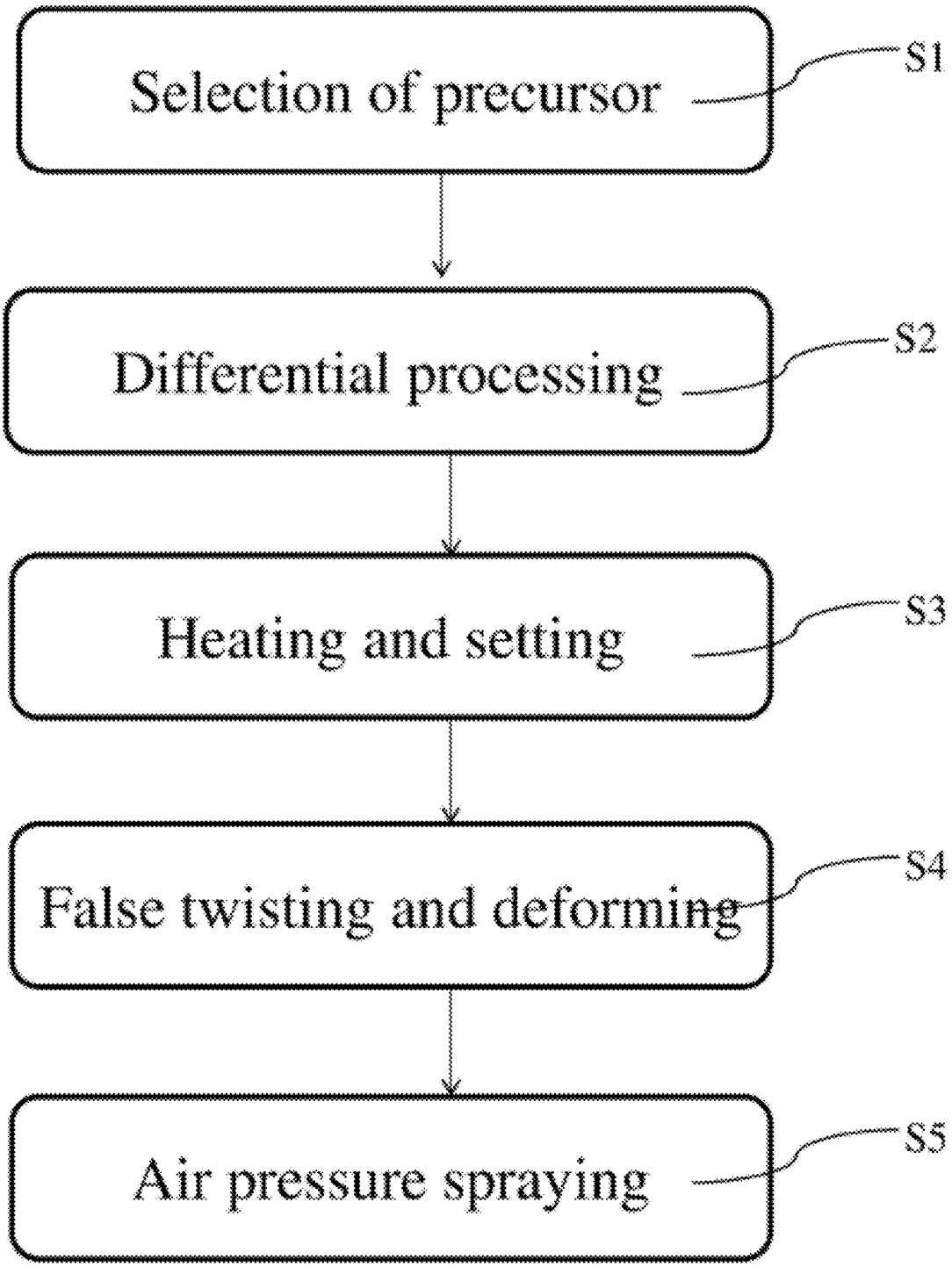
FIG. 2 is a schematic view of the single-material irregular extension multiple long-acting functional textured yarn according to the invention.
Figure 3:
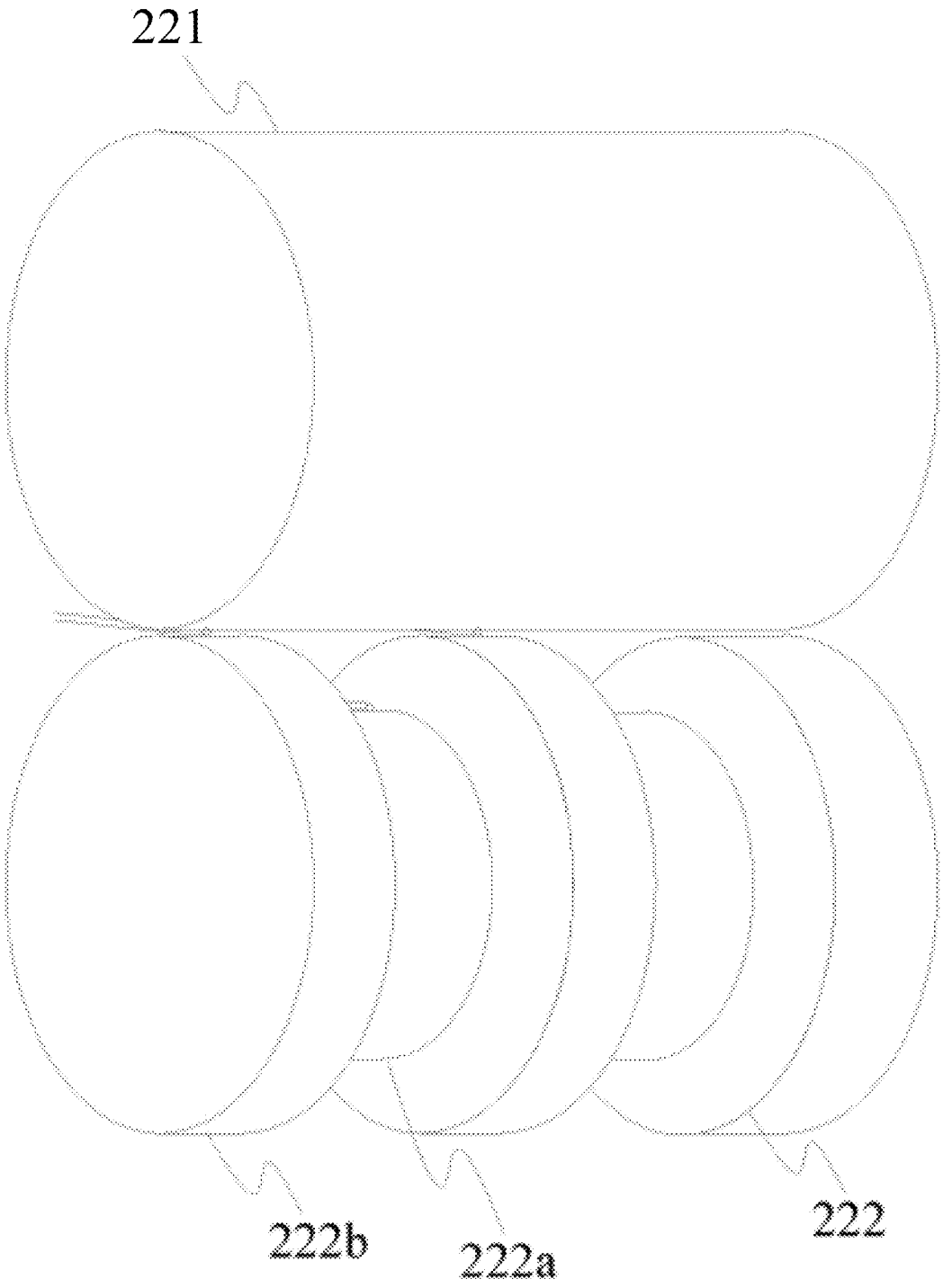
FIG. 3 is a perspective view of the differential roller in the manufacturing method of single-material irregular extension multiple long-acting functional textured yarn according to the invention.
Figure 4:
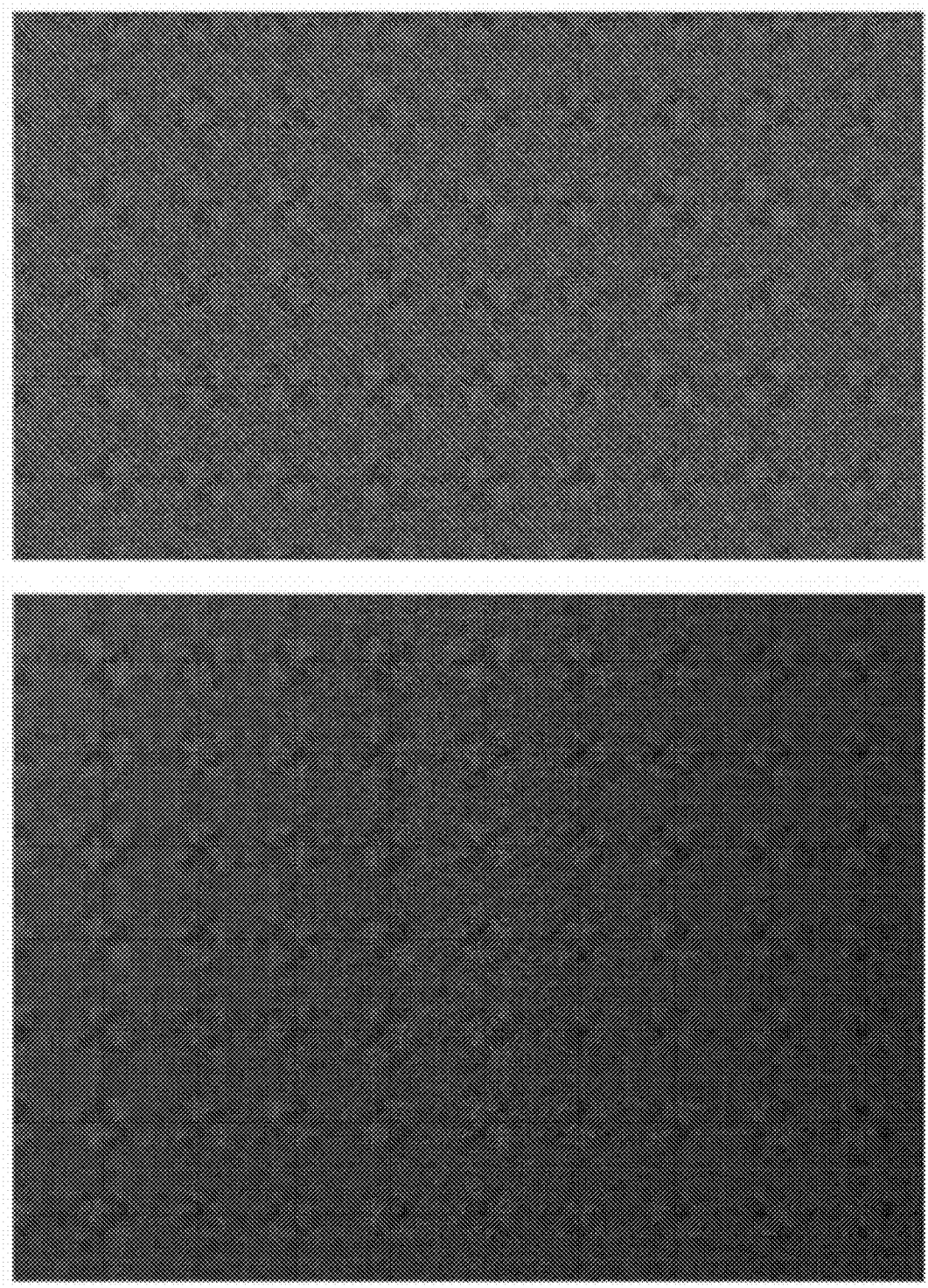
FIG. 4 is a product diagram of the long-lasting functional processed yarn produced from a single raw material with irregular elongation ratio.

The present invention is a "manufacturing method of single-material irregular extension multiple long-acting functional textured yarn, the textured yarn thereof, and the fabric made with the textured yarn thereof". Depicted in FIG. 1 to FIG. 4 are a flow chart of the manufacturing method of single-material irregular extension multiple long-acting functional textured yarn, a schematic view of the textured yarn, wherein, the processes of the manufacturing method of single-material irregular extension multiple long-acting functional textured yarn, a perspective view of the differential roller in the manufacturing method of single-material irregular extension multiple long-acting functional textured yarn, and a product diagram of the long-lasting functional processed yarn produced from a single raw material with irregular elongation ratio according to the invention are described as follow:

1. S1 Selection of precursor: Select a precursor of PET pre-oriented yarn (POY) with residual extension difference of 150%~160%, NDR (natural draw ratio) of more than 1.4%, and single filament DPF<0.5, modify it by adding 0.8%-1.2% titanium dioxide to form a first precursor (1);
2. S2 Differential processing: The first precursor (1) is fed into a flat conveying roller (21) with a speed of 68~73M/min, and then a differential roller (22) with a speed of 59~64M/min, and then an accelerating roller (23) with a speed of 95~102M/min to form a dark and light double colored textured yarn with linen-like appearance and tone. Characteristically, the differential roller (22) is made up of a rubber roller (221) and a metal embossed roller (222). When the first precursor (1) passes the embossed part (222*b*) of the metal embossed roller (222), the speed is 78~84M/min, and when the first precursor (1) passes the concave part (222*a*) of the metal embossed roller (222), it does not contact with the rubber roller (221), and the speed is 89~96M/min;
3. S3 Heating and setting: The dark and light double colored textured yarn is fed into a heater (3) for heating and setting. The heating temperature of the heater (3) is 180° C.~200° C.;
4. S4 False twisting and deforming: After heating and setting, the dark and light double colored textured yarn is conveyed to a false twisting machine (4) and is processed at a twist degree of 2200~2500 T/M to form a textured yarn with the feel of cotton. Specifically, the false twisting machine (4) uses a modified Mitsubishi ST-5 pin type;

5. S5 Air pressure spraying: Through a middle feeding roller (5) with a speed of 125~135M/min, the cotton-feel textured yarn after false twisting and deforming is conveyed to a nozzle (6) of 75~85 knot/m for spraying, thus forming a single-material irregular extension multiple long-acting functional textured yarn (7) (PRKHC).

For better understanding and recognition of the present invention, the technical means of the present invention is described in detail below with respect to a preferred embodiment.

Firstly, select a precursor of PET pre-oriented yarn (POY) with residual extension difference of 150%~160%, NDR (natural draw ratio) of more than 1.4%, and single filament DPF<0.5, modify it by adding 0.8%-1.2% titanium dioxide, to form a first precursor (1). The PET pre-oriented yarn features strong tenacity, easy stretch, resistance to impact and friction, and can be easily dyed. As the precursor, when added with titanium dioxide, it can generate long-acting UV resistance, and can significantly enhance the UV-resistant property of the final fabric. Then, the first precursor (1) is fed into a flat conveying roller (21) with a speed of 68~73M/min, and then fed into a differential roller (22) with a speed of 59~64M/min, and then fed into an accelerating roller (23) with a speed of 95~102M/min, to form a dark and light double colored textured yarn with linen-like appearance and tone (11). Specifically, the differential roller (22) is made up of a rubber roller (221) and a metal embossed roller (222). When the first precursor (1) passes the convex part (222*b*) of the metal embossed roller (222), the speed is 59~64M/min. When the first precursor (1) passes the concave part (222*a*) of the metal embossed roller (222), it does not contact with the rubber roller (221), and the speed is 68~73M/min. Therefore, after the first precursor (1) is fed into the flat conveying roller (21), the differential roller (22) and the accelerating roller (23), the precursor can generate irregular extension multiples, forming irregular interconnecting dark zones and light zones on the precursor. Thus, through process and machine updating, a dark and light double colored textured yarn with linen-like appearance and tone (11) can be produced from a single-material precursor. Then, the dark and light double colored textured yarn (11) is fed into a heater (3) with the heating temperature of 180° C.~200° C. for heating and setting. After heating and setting, the dark and light double colored textured yarn (11) is conveyed to a false twisting machine (4) and is processed at a twist degree of 2200~2500 T/M, forming a cotton-feel textured yarn. Then, through a middle feeding roller (5) with a speed of 125~135M/min, the cotton-feel textured yarn after false twisting and deforming is conveyed to a nozzle (6) of 75~85 knot/m for spraying, forming a single-material irregular extension multiple long-acting functional textured yarn (7) (PRKHC). Specifically, the false twisting machine (4) uses a modified Mitsubishi ST-5 pin type. Thus, through the above machine and process updating, after modification and false twisting, the single-material PET pre-oriented yarn can be made into a single-material irregular extension multiple long-acting functional textured yarn (7) (PRKHC) with linen-like appearance and tone, high elasticity, UV resistance, moisture absorbing and quick drying properties, as well as the feel of cotton.

Another preferred embodiment is used below to describe the technical means of the present invention:

Firstly, select a precursor of PET pre-oriented yarn (POY) with residual extension difference of 160%, natural draw ratio (NDR) of more than 1.4%, and single filament DPF=0.4, modify it by adding 1.0% titanium dioxide by means of polymerization processing, so as to form a long-acting UV-resistant first precursor (1); then, the first precursor (1) is fed into a flat conveying roller (21) with a speed of 72M/min, and then into a differential roller (22) with a speed of 62M/min, and then into an accelerating roller (23) with a speed of 100M/min, to form a dark and light double colored textured yarn with linen-like appearance and tone (11). Specifically, the differential roller (22) is made up of a rubber roller (221) and a metal embossed roller (222). When the first precursor (1) passes the convex part (222*b*) of the metal embossed roller (222), the speed is 62M/min. When the first precursor (1) passes the concave part (222*a*) of the metal embossed roller (222), it does not contact with the rubber roller (221), and the speed is 72M/min. Thus, when the first precursor (1) is fed into the flat conveying roller (21), the differential roller (22), and the accelerating roller (23), the precursor will generate irregular extension multiples, producing irregular interconnecting dark zones and light zones on the precursor. Through the improvement of manufacturing processes and machines, a dark and light double colored textured yarn with linen-like appearance and tone (11) can be produced from a single-material precursor. Then, the dark and light double colored textured yarn (11) is fed into a heater (3) with the heating temperature of 190° C. for heating and setting. After heating and setting, the dark and light double colored textured yarn (11) is conveyed to a false twisting machine (4) and is processed at a twist degree of 2400 T/M, to form a cotton-feel textured yarn with linen-like appearance and tone, high elasticity, and moisture absorbing and quick drying properties. Then, through a middle feeding roller (5) with a speed of 130M/min, the cotton-feel textured yarn after false twisting and deforming is conveyed to a nozzle (6) of 80 knot/m for spraying, to form a single-material irregular extension multiple long-acting functional textured yarn (7) (PRKHC). Thus, through the above machine and process upgrading, after modification and false twisting, the single-material PET pre-oriented yarn can be made into a double-colored cotton-feel single-material irregular extension multiple long-acting functional textured yarn (7) (PRKHC) with high elasticity, moisture absorbing and quick drying properties, UV resistance, linen-like appearance and tone. Then, using the single-material irregular extension multiple long-acting functional textured yarn (7) (PRKHC) as a warp, and using the single-material irregular extension multiple long-acting functional textured yarn (7) (PRKHC) with proportional addition of a regenerated fiber (RePreve) as a weft, a fabric can be woven out. The warp is 170(D)/144(F) single-material irregular extension multiple long-acting functional textured yarn (7) (PRKHC), and the weft is made of 170(D)/144(F) single-material irregular extension multiple long-acting functional textured yarn (7) (PRKHC) with addition of 75(D/2)/144(F) RePreve environmental fiber. The functional fabric is formed by weaving the warp and weft at warp density of 111 (Picks/inches) and weft density of 103 (Picks/inches). The functional fabric contains 22% regenerated fiber (RePreve). Finally, after dyeing and finishing, the functional fabric can have linen-like appearance and tone. The finished product is a cotton-feel irregular extension multiple long-acting functional fabric ((Cloth No.: B1149, Specification: warp density 111 (Picks/inches), weft density 103 (Picks/inches), width 57", weight 265 g/y)).

Although the invention has been explained in relation to its preferred embodiment, it is to be understood that many other possible modifications and variations can be made without departing from the spirit and scope of the invention as hereinafter claimed.

In summary, the embodiments of the present invention can truly accomplish the anticipated functions. The specific structure disclosed in the invention is not seen in other similar products, and is not made public before the application.

The invention claimed is:

1. A manufacturing method of single-material irregular extension multiple long-acting functional textured yarn (PRKHC), comprising the following steps:

1) selection of precursor: select a precursor of PET pre-oriented yarn (POY) with residual extension difference of 150%~160%, and NDR (natural draw ratio) of more than 1.4%, and with single filament DPF<0.5, and modify it by mixing it with 0.8%-1.2% titanium dioxide to form a first precursor;
2) differential processing: feed the first precursor into a flat conveying roller with a speed of 68~73M/min, and then into a differential roller with a speed of 59~64M/min, and then into an accelerating roller with a speed of 95~102M/min to form a dark and light double colored textured yarn with linen-like appearance and tone; characteristically, the differential roller is made up of a rubber roller and a metal embossed roller;
3) heating and setting: the dark and light double colored textured yarn is conveyed to a heater for heating and setting, the heating temperature of the heater is 180° C.~200° C.;
4) false twisting and deforming: after heating and setting, the dark and light double colored textured yarn is conveyed to a false twisting machine and is processed at a twist degree of 2200~2500 T/M, to form a cotton-feel textured yarn with linen-like appearance and tone, high elasticity, and moisture absorbing and quick drying properties, specifically, the false twisting machine uses a modified Mitsubishi ST-5 pin type; and
5) air pressure spraying: through a middle feeding roller with a speed of 125~135M/min, the cotton-feel textured yarn after false twisting and deforming is conveyed to a nozzle of 75~85 knot/m for spraying, to form a single-material irregular extension multiple long-acting functional textured yarn (PRKHC).

* * * * *